US008035060B2

(12) United States Patent
North et al.

(10) Patent No.: US 8,035,060 B2
(45) Date of Patent: Oct. 11, 2011

(54) INKJET PRINTHEAD WITH A PLURALITY OF VAPOR BUBBLE GENERATORS

(75) Inventors: Angus John North, Balmain (AU); Samuel James Myers, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 510 days.

(21) Appl. No.: 12/056,149

(22) Filed: Mar. 26, 2008

(65) Prior Publication Data

US 2008/0174621 A1 Jul. 24, 2008

Related U.S. Application Data

(63) Continuation of application No. 11/544,778, filed on Oct. 10, 2006, now Pat. No. 7,491,911.

(51) Int. Cl.
*H05B 1/00* (2006.01)
*B41J 29/38* (2006.01)

(52) U.S. Cl. ..... 219/216; 219/469; 219/471; 219/474; 219/243; 219/486; 219/470; 219/472; 219/501; 219/499; 219/497; 347/11; 347/57; 347/20; 347/54; 347/56; 347/60; 347/12; 347/10; 347/14; 347/15; 399/69; 399/67; 399/329; 399/330; 399/335

(58) Field of Classification Search ..... 219/216, 219/469–474, 243, 486, 501, 499, 497; 399/67, 399/69, 329–335; 347/20, 54, 56, 60, 12, 10, 11, 14–5, 62, 57, 48, 94
See application file for complete search history.

(56) References Cited

U.S. PATENT DOCUMENTS

| | | | | |
|---|---|---|---|---|
| 4,746,937 | A | 5/1988 | Realis Luc et al. | |
| 5,886,716 | A | 3/1999 | Heinzl et al. | |
| 6,296,350 | B1 * | 10/2001 | Cornell et al. | 347/60 |
| 2002/0109754 | A1 | 8/2002 | Fujii | |
| 2005/0007423 | A1 | 1/2005 | Iida et al. | |
| 2005/0179739 | A1 | 8/2005 | Freire et al. | |

FOREIGN PATENT DOCUMENTS

| | | | |
|---|---|---|---|
| EP | 0354982 | A1 | 2/1990 |
| EP | 0373894 | A2 | 6/1990 |
| EP | 1033249 | A1 | 9/2000 |
| EP | 1060891 | A2 | 12/2000 |
| JP | 5220963 | A | 8/1993 |

* cited by examiner

*Primary Examiner* — Shawntina Fuqua

(57) ABSTRACT

The invention provides for an inkjet printhead having a plurality of micro-electromechanical vapor bubble generators. Each bubble generator includes a nozzle in fluid communication with an ink chamber, and a heater positioned in thermal contact with ink in the chamber. Each generator also includes drive circuitry configured to provide a modulated pulse to the heater to generate a vapor bubble in the ink in said chamber, the pulse comprising a pre-heat series of a predetermined number of pulses separated by a predetermined period, followed by a trigger pulse of a period twice that of said predetermined period.

3 Claims, 4 Drawing Sheets

INKJET PRINTHEAD WITH A PLURALITY OF VAPOR BUBBLE GENERATORS

CROSS REFERENCE TO RELATED APPLICATIONS

This application is a continuation application of U.S. patent application Ser. No. 11/544,778 filed on Oct. 10, 2006, all of which are herein incorporated by reference.

FIELD OF THE INVENTION

The invention relates to MEMS devices and in particular MEMS devices that vaporize liquid to generate a vapor bubble during operation.

CO-PENDING APPLICATIONS

The following applications have been filed by the Applicant simultaneously with the present application:

| | | | | | |
|---|---|---|---|---|---|
| 11/544,763 | 11/544,764 | 11/544,765 | 11/544,766 | 11/544,767 | 11/544,768 |
| 11/544,769 | 11/544,770 | 11/544,771 | 11/544,772 | 11/544,773 | 11/544,774 |
| 11/544,775 | 11/544,776 | 11/544,777 | 11/544,779 | | |

The disclosures of these co-pending applications are incorporated herein by reference.

CROSS REFERENCES TO RELATED APPLICATIONS

Various methods, systems and apparatus relating to the present invention are disclosed in the following U.S. patents/patent applications filed by the applicant or assignee of the present invention:

| | | | | | |
|---|---|---|---|---|---|
| 6,750,901 | 6,476,863 | 6,788,336 | 7,249,108 | 6,566,858 | 6,331,946 |
| 6,246,970 | 6,442,525 | 09/517,384 | 09/505,951 | 6,374,354 | 7,246,098 |
| 6,816,968 | 6,757,832 | 6,334,190 | 6,745,331 | 7,249,109 | 7,197,642 |
| 7,093,139 | 10/636,263 | 10/636,283 | 10/866,608 | 7,210,038 | 10/902,883 |
| 10/940,653 | 10/942,858 | 11/003,786 | 7,258,417 | 7,293,853 | 7,328,968 |
| 7,270,395 | 11/003,404 | 11/003,419 | 11/003,700 | 7,255,419 | 7,284,819 |
| 7,229,148 | 7,258,416 | 7,273,263 | 7,270,393 | 6,984,017 | 11/003,699 |
| 11/071,473 | 11/003,463 | 11/003,701 | 11/003,683 | 11/003,614 | 7,284,820 |
| 11/003,684 | 7,246,875 | 7,322,669 | 11/293,800 | 11/293,802 | 11/293,801 |
| 11/293,808 | 11/293,809 | 11/482,975 | 11/482,970 | 11/482,968 | 11/482,972 |
| 11/482,971 | 11/482,969 | 11/246,676 | 11/246,677 | 11/246,678 | 11/246,679 |
| 11/246,680 | 11/246,681 | 11/246,714 | 11/246,713 | 11/246,689 | 11/246,671 |
| 11/246,670 | 11/246,669 | 11/246,704 | 11/246,710 | 11/246,688 | 11/246,716 |
| 11/246,715 | 11/246,707 | 11/246,706 | 11/246,705 | 11/246,708 | 11/246,693 |
| 11/246,692 | 11/246,696 | 11/246,695 | 11/246,694 | 11/482,958 | 11/482,955 |
| 11/482,962 | 11/482,963 | 11/482,956 | 11/482,954 | 11/482,974 | 11/482,957 |
| 11/482,987 | 11/482,959 | 11/482,960 | 11/482,961 | 11/482,964 | 11/482,965 |
| 11/482,976 | 11/482,973 | 11/495,815 | 11/495,816 | 11/495,817 | 6,623,101 |
| 6,406,129 | 6,505,916 | 6,457,809 | 6,550,895 | 6,457,812 | 7,152,962 |
| 6,428,133 | 7,204,941 | 7,282,164 | 10/815,628 | 7,278,727 | 10/913,373 |
| 10/913,374 | 10/913,372 | 7,138,391 | 7,153,956 | 10/913,380 | 10/913,379 |
| 10/913,376 | 7,122,076 | 7,148,345 | 11/172,816 | 11/172,815 | 11/172,814 |
| 11/482,990 | 11/482,986 | 11/482,985 | 11/454,899 | 10/407,212 | 7,252,366 |
| 10/683,064 | 10/683,041 | 11/482,967 | 11/482,966 | 11/482,988 | 11/482,989 |
| 11/293,832 | 11/293,838 | 11/293,825 | 11/293,841 | 11/293,799 | 11/293,796 |
| 11/293,797 | 11/293,798 | 11/124,158 | 11/124,196 | 11/124,199 | 11/124,162 |
| 11/124,202 | 11/124,197 | 11/124,154 | 11/124,198 | 7,284,921 | 11/124,151 |
| 11/124,160 | 11/124,192 | 11/124,175 | 11/124,163 | 11/124,149 | 11/124,152 |
| 11/124,173 | 11/124,155 | 7,236,271 | 11/124,174 | 11/124,194 | 11/124,164 |
| 11/124,200 | 11/124,195 | 11/124,166 | 11/124,150 | 11/124,172 | 11/124,165 |
| 11/124,186 | 11/124,185 | 11/124,184 | 11/124,182 | 11/124,201 | 11/124,171 |
| 11/124,181 | 11/124,161 | 11/124,156 | 11/124,191 | 11/124,159 | 11/124,188 |
| 11/124,170 | 11/124,187 | 11/124,189 | 11/124,190 | 11/124,180 | 11/124,193 |

-continued

| | | | | | |
|---|---|---|---|---|---|
| 11/124,183 | 11/124,178 | 11/124,177 | 11/124,148 | 11/124,168 | 11/124,167 |
| 11/124,179 | 11/124,169 | 11/187,976 | 11/188,011 | 11/188,014 | 11/482,979 |
| 11/228,540 | 11/228,500 | 11/228,501 | 11/228,530 | 11/228,490 | 11/228,531 |
| 11/228,504 | 11/228,533 | 11/228,502 | 11/228,507 | 11/228,482 | 11/228,505 |
| 11/228,497 | 11/228,487 | 11/228,529 | 11/228,484 | 11/228,489 | 11/228,518 |
| 11/228,536 | 11/228,496 | 11/228,488 | 11/228,506 | 11/228,516 | 11/228,526 |
| 11/228,539 | 11/228,538 | 11/228,524 | 11/228,523 | 11/228,519 | 11/228,528 |
| 11/228,527 | 11/228,525 | 11/228,520 | 11/228,498 | 11/228,511 | 11/228,522 |
| 11/228,515 | 11/228,537 | 11/228,534 | 11/228,491 | 11/228,499 | 11/228,509 |
| 11/228,492 | 11/228,493 | 11/228,510 | 11/228,508 | 11/228,512 | 11/228,514 |
| 11/228,494 | 11/228,495 | 11/228,486 | 11/228,481 | 11/228,477 | 11/228,485 |
| 11/228,483 | 11/228,521 | 11/228,517 | 11/228,532 | 11/228,513 | 11/228,503 |
| 11/228,480 | 11/228,535 | 11/228,478 | 11/228,479 | 6,238,115 | 6,386,535 |
| 6,398,344 | 6,612,240 | 6,752,549 | 6,805,049 | 6,971,313 | 6,899,480 |
| 6,860,664 | 6,925,935 | 6,966,636 | 7,024,995 | 7,284,852 | 6,926,455 |
| 7,056,038 | 6,869,172 | 7,021,843 | 6,988,845 | 6,964,533 | 6,981,809 |
| 7,284,822 | 7,258,067 | 7,322,757 | 7,222,941 | 7,284,925 | 7,278,795 |
| 7,249,904 | 7,152,972 | 11/246,687 | 11/246,718 | 7,322,681 | 11/246,686 |
| 11/246,703 | 11/246,691 | 11/246,711 | 11/246,690 | 11/246,712 | 11/246,717 |
| 11/246,709 | 11/246,700 | 11/246,701 | 11/246,702 | 11/246,668 | 11/246,697 |
| 11/246,698 | 11/246,699 | 11/246,675 | 11/246,674 | 11/246,667 | 7,156,508 |
| 7,159,972 | 7,083,271 | 7,165,834 | 7,080,894 | 7,201,469 | 7,090,336 |
| 7,156,489 | 10/760,233 | 10/760,246 | 7,083,257 | 7,258,422 | 7,255,423 |
| 7,219,980 | 10/760,253 | 10/760,255 | 10/760,209 | 7,118,192 | 10/760,194 |
| 7,322,672 | 7,077,505 | 7,198,354 | 7,077,504 | 10/760,189 | 7,198,355 |
| 10/760,232 | 7,322,676 | 7,152,959 | 7,213,906 | 7,178,901 | 7,222,938 |
| 7,108,353 | 7,104,629 | 11/446,227 | 11/454,904 | 11/472,345 | 11/474,273 |
| 7,261,401 | 11/474,279 | 11/482,939 | 7,328,972 | 7,322,673 | 7,303,930 |
| 11/246,672 | 11/246,673 | 11/246,683 | 11/246,682 | 7,246,886 | 7,128,400 |
| 7,108,355 | 6,991,322 | 7,287,836 | 7,118,197 | 10/728,784 | 10/728,783 |
| 7,077,493 | 6,962,402 | 10/728,803 | 7,147,308 | 10/728,779 | 7,118,198 |
| 7,168,790 | 7,172,270 | 7,229,155 | 6,830,318 | 7,195,342 | 7,175,261 |
| 10/773,183 | 7,108,356 | 7,118,202 | 10/773,186 | 7,134,744 | 10/773,185 |
| 7,134,743 | 7,182,439 | 7,210,768 | 10/773,187 | 7,134,745 | 7,156,484 |
| 7,118,201 | 7,111,926 | 10/773,184 | 7,018,021 | 11/060,751 | 11/060,805 |
| 11/188,017 | 7,128,402 | 11/298,774 | 11/329,157 | 11/490,041 | 11/501,767 |
| 7,284,839 | 7,246,885 | 7,229,156 | 11/505,846 | 11/505,857 | 7,293,858 |
| 7,258,427 | 11/097,308 | 11/097,309 | 7,246,876 | 11/097,299 | 11/097,310 |
| 11/097,213 | 7,328,978 | 11/097,212 | 7,147,306 | 11/482,953 | 11/482,977 |
| 09/575,197 | 7,079,712 | 6,825,945 | 7,330,974 | 6,813,039 | 6,987,506 |
| 7,038,797 | 6,980,318 | 6,816,274 | 7,102,772 | 09/575,186 | 6,681,045 |
| 6,728,000 | 7,173,722 | 7,088,459 | 09/575,181 | 7,068,382 | 7,062,651 |
| 6,789,194 | 6,789,191 | 6,644,642 | 6,502,614 | 6,622,999 | 6,669,385 |
| 6,549,935 | 6,987,573 | 6,727,996 | 6,591,884 | 6,439,706 | 6,760,119 |
| 7,295,332 | 6,290,349 | 6,428,155 | 6,785,016 | 6,870,966 | 6,822,639 |
| 6,737,591 | 7,055,739 | 7,233,320 | 6,830,196 | 6,832,717 | 6,957,768 |
| 09/575,172 | 7,170,499 | 7,106,888 | 7,123,239 | 10/727,181 | 10/727,162 |
| 10/727,163 | 10/727,245 | 7,121,639 | 7,165,824 | 7,152,942 | 10/727,157 |
| 7,181,572 | 7,096,137 | 7,302,592 | 7,278,034 | 7,188,282 | 10/727,159 |
| 10/727,180 | 10/727,179 | 10/727,192 | 10/727,274 | 10/727,164 | 10/727,161 |
| 10/727,198 | 10/727,158 | 10/754,536 | 10/754,938 | 10/727,227 | 10/727,160 |
| 10/934,720 | 7,171,323 | 7,278,697 | 11/474,278 | 11/488,853 | 7,328,115 |
| 10/296,522 | 6,795,215 | 7,070,098 | 7,154,638 | 6,805,419 | 6,859,289 |
| 6,977,751 | 6,398,332 | 6,394,573 | 6,622,923 | 6,747,760 | 6,921,144 |
| 10/884,881 | 7,092,112 | 7,192,106 | 11/039,866 | 7,173,739 | 6,986,560 |
| 7,008,033 | 11/148,237 | 7,222,780 | 7,270,391 | 11/478,599 | 11/499,749 |
| 11/482,981 | 7,195,328 | 7,182,422 | 10/854,521 | 10/854,522 | 10/854,488 |
| 7,281,330 | 10/854,503 | 10/854,504 | 10/854,509 | 7,188,928 | 7,093,989 |
| 10/854,497 | 10/854,495 | 10/854,498 | 10/854,511 | 10/854,512 | 10/854,525 |
| 10/854,526 | 10/854,516 | 7,252,353 | 10/854,515 | 7,267,417 | 10/854,505 |
| 10/854,493 | 7,275,805 | 7,314,261 | 10/854,490 | 7,281,777 | 7,290,852 |
| 10/854,528 | 10/854,523 | 10/854,527 | 10/854,524 | 10/854,520 | 10/854,514 |
| 10/854,519 | 10/854,513 | 10/854,499 | 10/854,501 | 7,266,661 | 7,243,193 |
| 10/854,518 | 10/854,517 | 10/934,628 | 7,163,345 | 7,322,666 | 11/293,804 |
| 11/293,840 | 11/293,803 | 11/293,833 | 11/293,834 | 11/293,835 | 11/293,836 |
| 11/293,837 | 11/293,792 | 11/293,794 | 11/293,839 | 11/293,826 | 11/293,829 |
| 11/293,830 | 11/293,827 | 11/293,828 | 7,270,494 | 11/293,823 | 11/293,824 |
| 11/293,831 | 11/293,815 | 11/293,819 | 11/293,818 | 11/293,817 | 11/293,816 |
| 11/482,978 | 10/760,254 | 10/760,210 | 10/760,202 | 7,201,468 | 10/760,198 |
| 10/760,249 | 7,234,802 | 7,303,255 | 7,287,846 | 7,156,511 | 10/760,264 |
| 7,258,432 | 7,097,291 | 10/760,222 | 10/760,248 | 7,083,273 | 10/760,192 |
| 10/760,203 | 10/760,204 | 10/760,205 | 10/760,206 | 10/760,267 | 10/760,270 |
| 7,198,352 | 10/760,271 | 7,303,251 | 7,201,470 | 7,121,655 | 7,293,861 |
| 7,232,208 | 10/760,186 | 10/760,261 | 7,083,272 | 7,311,387 | 11/014,764 |
| 11/014,763 | 11/014,748 | 11/014,747 | 7,328,973 | 11/014,760 | 11/014,757 |
| 7,303,252 | 7,249,822 | 11/014,762 | 7,311,382 | 11/014,723 | 11/014,756 |
| 11/014,736 | 11/014,759 | 11/014,758 | 11/014,725 | 11/014,739 | 11/014,738 |
| 11/014,737 | 7,322,684 | 7,322,685 | 7,311,381 | 7,270,405 | 7,303,268 |
| 11/014,735 | 11/014,734 | 11/014,719 | 11/014,750 | 11/014,749 | 7,249,833 |
| 11/014,769 | 11/014,729 | 11/014,743 | 11/014,733 | 7,300,140 | 11/014,755 |

-continued

| | | | | | |
|---|---|---|---|---|---|
| 11/014,765 | 11/014,766 | 11/014,740 | 7,284,816 | 7,284,845 | 7,255,430 |
| 11/014,744 | 11/014,741 | 11/014,768 | 7,322,671 | 11/014,718 | 11/014,717 |
| 11/014,716 | 11/014,732 | 11/014,742 | 11/097,268 | 11/097,185 | 11/097,184 |
| 11/293,820 | 11/293,813 | 11/293,822 | 11/293,812 | 11/293,821 | 11/293,814 |
| 11/293,793 | 11/293,842 | 11/293,811 | 11/293,807 | 11/293,806 | 11/293,805 |
| 11/293,810 | 11/482,982 | 11/482,983 | 11/482,984 | 11/495,818 | 11/495,819 |

BACKGROUND OF THE INVENTION

Some micro-mechanical systems (MEMS) devices process or use liquids to operate. In one class of these liquid-containing devices, resistive heaters are used to heat the liquid to the liquid's superheat limit, resulting in the formation of a rapidly expanding vapor bubble. The impulse provided by the bubble expansion can be used as a mechanism for moving liquid through the device. This is the case in thermal inkjet printheads where each nozzle has a heater that generates a bubble to eject a drop of ink onto the print media. In light of the widespread use of inkjet printers, the present invention will be described with particular reference to its use in this application. However, it will be appreciated that the invention is not limited to inkjet printheads and is equally suited to other devices in which vapor bubbles formed by resistive heaters are used to move liquid through the device (e.g. some 'Lab-on-a-chip' devices).

The time scale for heating a liquid to its superheat limit determines how much thermal energy will be stored in the liquid when the superheat limit is reached: this determines how much vapor will be produced and the impulse of the expanding vapor bubble (impulse being defined as pressure integrated over area and time). Longer time scales for heating result in a greater volume of liquid being heated and hence a larger amount of stored energy, a larger amount of vapor and larger bubble impulse. This leads to some degree of tunability for the bubbles produced by MEMS heaters. Controlling the time scale for heating to the superheat limit is simply a matter of controlling the power supplied to the heater during the nucleation event: lower power will result in a longer nucleation time and larger bubble impulse, at the cost of an increased energy requirement (the extra energy stored in the liquid must be supplied by the heater). Controlling the power may be done by way of reduced voltage across the heater or by way of pulse width modulation of the voltage to obtain a lower time averaged power.

While this effect may be useful in controlling e.g. the flow rate of a MEMS bubble pump or the force applied to a clogged nozzle in an inkjet printer (the subject of a co-pending application referred to temporarily by Ser. No. 11/544,770), the designer of such a system must be wary of ensuring bubble stability. A typical heater heating a water-based liquid will generate unstable, non-repeatable bubbles if the time scale for heating is much longer than 1 microsecond (see FIG. 1). This non-repeatability will compromise device operation or severely limit the range of bubble impulse available to the designer.

SUMMARY OF THE INVENTION

Accordingly the present invention provides a MEMS vapour bubble generator comprising:

a chamber for holding liquid;

a heater positioned in the chamber for thermal contact with the liquid; and, drive circuitry for providing the heater with an electrical pulse such that the heater generates a vapour bubble in the liquid; wherein, the pulse has a first portion with insufficient power to nucleate the vapour bubble and a second portion with power sufficient to nucleate the vapour bubble, subsequent to the first portion.

If the heating pulse is shaped to increase the heating rate prior to the end of the pulse, bubble stability can be greatly enhanced, allowing access to a regime where large, repeatable bubbles can be produced by small heaters.

Preferably the first portion of the pulse is a pre-heat section for heating the liquid but not nucleating the vapour bubble and the second portion is a trigger section for nucleating the vapour bubble. In a further preferred form, the pre-heat section has a longer duration than the trigger section. Preferably, the pre-heat section is at least two micro-seconds long. In a further preferred form, the trigger section is less than a micro-section long.

Preferably, the drive circuitry shapes the pulse using pulse width modulation. In this embodiment, the pre-heat section is a series of sub-nucleating pulses. Optionally, the drive circuitry shapes the pulse using voltage modulation.

In some embodiments, the time averaged power in the pre-heat section is constant and the time averaged power in the trigger section is constant. In particularly preferred embodiments, the MEMS vapour bubble generator is used in an inkjet printhead to eject printing fluid from nozzle in fluid communication with the chamber.

Using a low power over a long time scale (typically >>1 μs) to store a large amount of thermal energy in the liquid surrounding the heater without crossing over the nucleation temperature, then switching to a high power to cross over the nucleation temperature in a short time scale (typically <1 μs), triggers nucleation and releasing the stored energy.

Optionally, the first portion of the pulse is a pre-heat section for heating the liquid but not nucleating the vapour bubble and the second portion is a trigger section for superheating some of the liquid to nucleate the vapour bubble.

Optionally, the pre-heat section has a longer duration than the trigger section.

Optionally, the pre-heat section is at least two micro-seconds long.

Optionally, the trigger section is less than one micro-section long.

Optionally, the drive circuitry shapes the pulse using pulse width modulation.

Optionally, the pre-heat section is a series of sub-nucleating pulses.

Optionally, the drive circuitry shapes the pulse using voltage modulation.

Optionally, the time averaged power in the pre-heat section is constant and the time averaged power in the trigger section is constant.

In another aspect the present invention provides a MEMS vapour bubble generator used in an inkjet printhead to eject printing fluid from a nozzle in fluid communication with the chamber.

Optionally, the heater is suspended in the chamber for immersion in a printing fluid.

Optionally, the pulse is generated for recovering a nozzle clogged with dried or overly viscous printing fluid.

BRIEF DESCRIPTION OF DRAWINGS

Preferred embodiments of the invention will now be described with reference to the accompanying drawings, in which.

DETAILED DESCRIPTION OF THE PREFERRED EMBODIMENTS

Figure 1A:
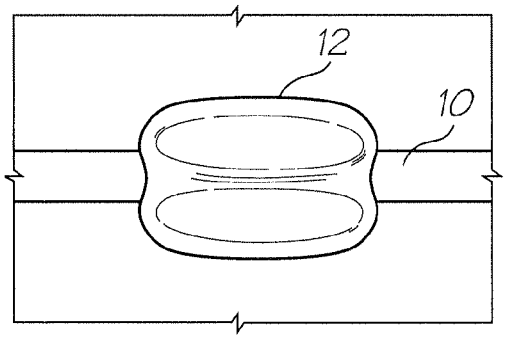
FIGS. 1A to 1E show water vapour bubbles generated at different heating rates.

In a MEMS fluid pump, large, stable and repeatable bubbles are desirable for efficient and reliable operation. To analyse the mechanisms that influence bubble nucleation and growth, it is necessary to consider the spatial uniformity of the heater's temperature profile and then consider the time evolution of the profile. Finite element thermal models of heaters in liquid can be used to show that the heating rate of the heater strongly influences the spatial uniformity of temperature across the heater. This is because since different portions of the heater are heat-sunk to different degrees (the sides of the heater will be colder due to enhanced cooling by the liquid and the ends of the heater will be colder due to enhanced cooling by the contacts). At low powers, where the time scale for heating to the superheat limit is large with respect to the thermal time scales of the cooling mechanisms, the temperature profile of the heater will be strongly distorted by cooling at the boundaries of the heater. Ideally the temperature profile would be a "top-hat", with uniform temperature across the whole heater, but in the case of low heating rates, the edges of the temperature profile will be pulled down.

The top-hat temperature profile is ideal for maximising the effectiveness of the heater, as only those portions of the heater above the superheat limit will contribute significantly to the bubble impulse. The nucleation rate is a very strong exponential function of temperature near the superheat limit. Portions of the heater that are even a few degrees below the superheat limit will produce a much lower nucleation rate than those portions above the superheat limit. These portions of the heater have much less contribution to the bubble impulse as they will be thermally isolated by bubbles expanding from hotter portions of the heater. In other words, if the temperature profile across the heater is not uniform, there can exist a race condition between bubble nucleation on colder parts of the heater and bubbles expanding from hotter parts of the heater. It is this race condition that can cause the non-repeatability of bubbles formed with low heating rates.

The term "low heating rates" is a relative term and depends on the geometry of the heater and its contacts and the thermal properties of all materials in thermal contact with the heater. All of these will influence the time scales of the cooling mechanisms. A typical heater material in a typical configuration applicable to inkjet printers will begin to manifest the race condition if the time scale for nucleation exceeds 1 μs. The exact threshold is unimportant as any heater will be subject to the race condition and the consequent bubble instability if the heating rate is low enough. This will limit the range of bubble impulse available to the designer.

FIGS. 1A to 1E are line drawings of stroboscopic photographs of vapour bubbles 12 generated at different heating rates by varying the voltage of the drive pulse. Using a strobe with a duration of 0.3 microseconds, the images show capture the bubbles at their greatest extent. The heater 10 is 30 μm×4 μm in an open pool of water at an angle of 15 degrees from the support wafer surface. The dual bubble appearance is due to a reflected image of the bubble on the wafer surface.

Figure 1B:
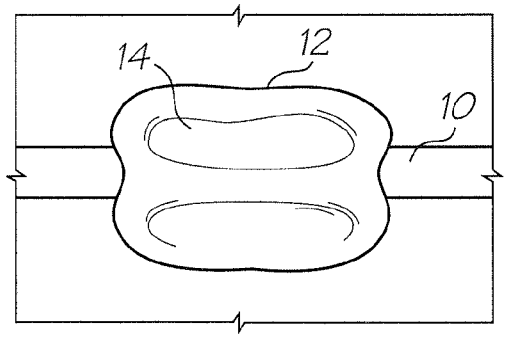
Figure 1C:
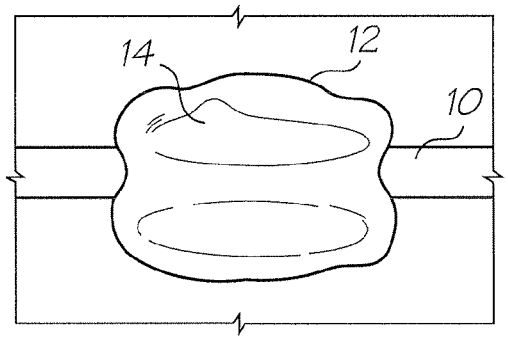
Figure 1D:
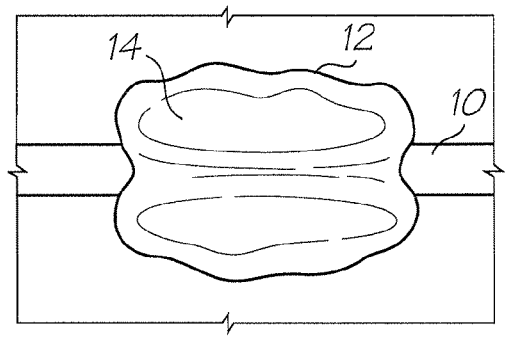
Figure 1E:
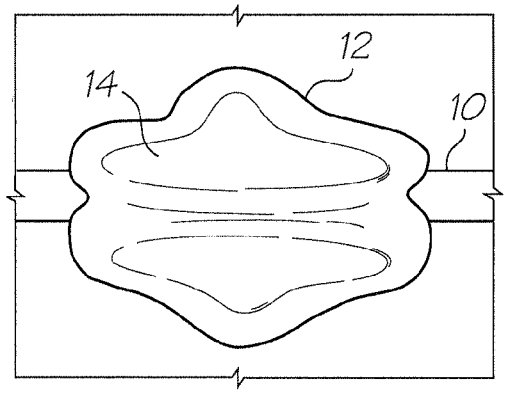

In FIG. 1A, the drive voltage is 5 volts and the bubble 12 reaches its maximum extent at 1 microsecond. The bubble is relatively small but has a regular shape along the heater length. In FIG. 1B, the drive voltage decreases to 4.1 volts and the time to maximum bubble growth increases to 2 microseconds. Consequently, the bubble 12 is larger but bubble irregularities 14 start to occur. The pulse voltage progressively decreases in FIGS. 1C, 1D and 1E (3.75V, 3.45V and 2.95V respectively). As the voltage decreases, so to does the heating rate, thereby increasing the time scale for reaching the liquid superheat limit. This allows more time for heat leakage into the liquid, resulting in a larger amount of stored thermal energy and the production of more vapor when bubble nucleation occurs. In other words, the size of the bubble 12 increases. Lower voltages therefore result in greater bubble impulse, allowing the bubble to grow to a greater extent. Unfortunately, the irregularities 12 in the bubble shape also increase. Hence the bubble is potentially unstable and non-repeatable when the time scale for heating to the superheat limit exceeds 1 microsecond. In FIGS. 1A to 1E, the time to maximum bubble size is 1, 2, 3, 5, and 10 microseconds respectively.

Figure 2A:
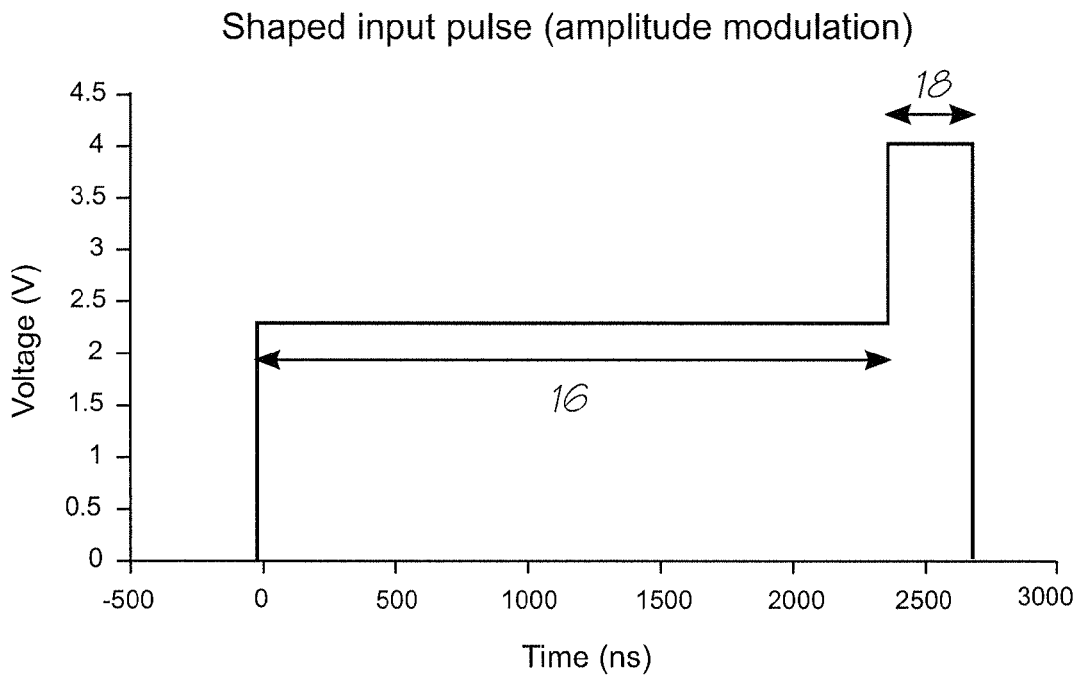
FIGS. 2A and 2B show two alternatives for shaping the pulse into pre-heat and trigger sections.
Figure 2B:
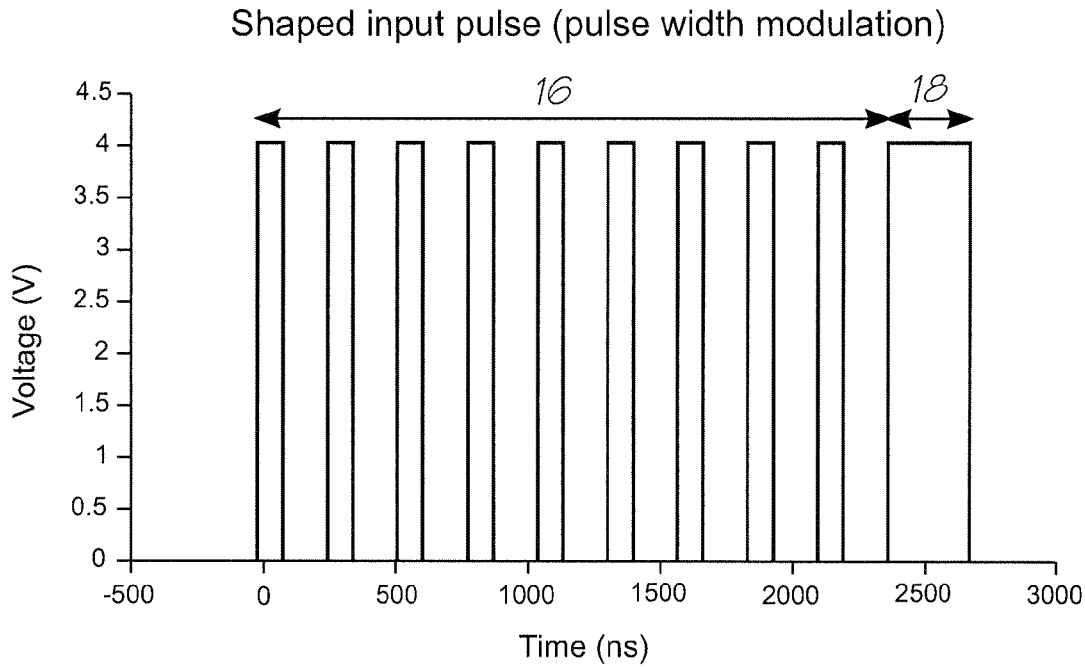

The invention provides a way of avoiding the instability caused by the race condition so that the designer can use low heating rates to generate a large bubble impulse on a heater with fixed geometry and thermal properties. FIGS. 2A and 2B shows two possibilities for driving the heaters to produce large, stable bubbles. In FIG. 2A, the drive circuit uses amplitude modulation to decrease the power of the pre-heat section 16 relative to the trigger section 18. In FIG. 2B, pulse width modulation of the voltage (creating a rapid series of sub-ejection pulses) can be used to reduce the power of the pre-heat phase 16 compared to the trigger section 18.

Ordinary workers in this field will appreciate that there are an infinite variety of pulse shapes that will satisfy the criteria of a relatively low powered pre-heat section and a subsequent trigger section that nucleates the bubble. Shaping the pulse can be done with pulse width modulation, voltage modulation or a combination of both. However, pulse width modulation is the preferred method of shaping the pulse, being more amenable to CMOS circuit design. It should also be noted that the pulse is not limited to a pre-heat and trigger section only; additional pulse sections may be included for other purposes without negating the benefits of the present invention. Furthermore, the sections need not maintain constant power levels. Constant time averaged power is preferred for the pre-heat section and the trigger section, as that is the simplest case to handle theoretically and experimentally.

Figure 3:
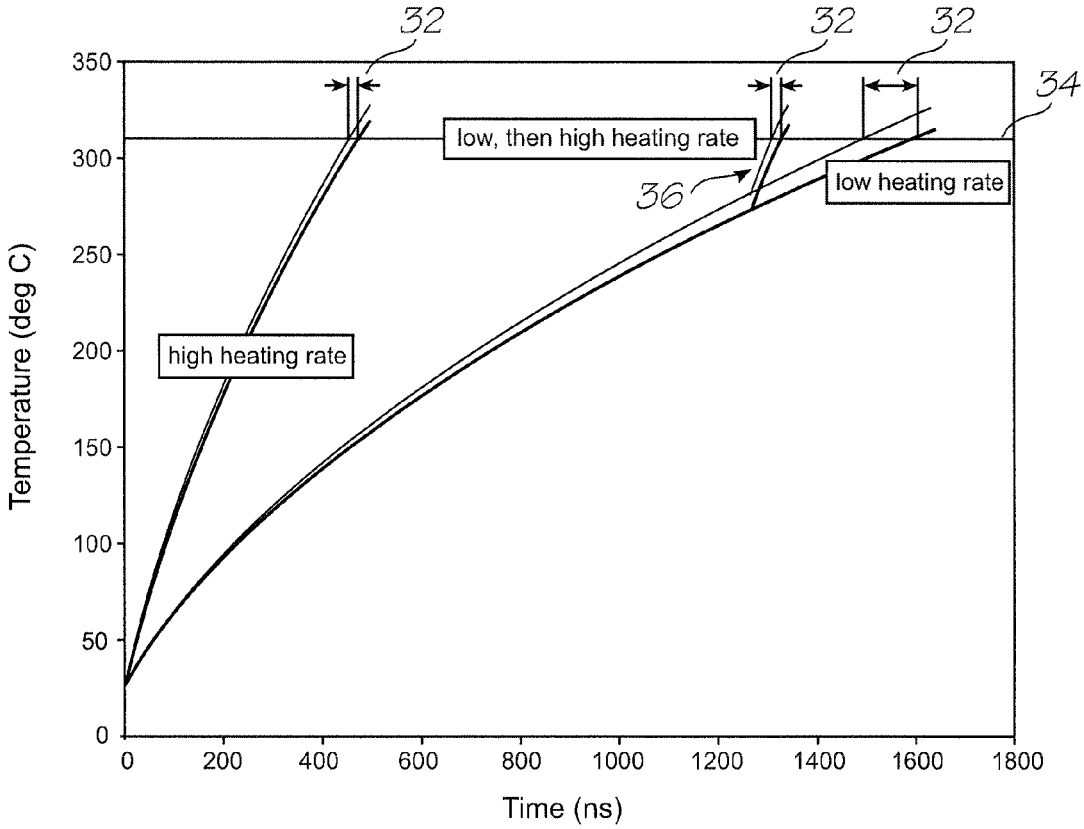
FIG. 3 is a plot of the hottest point on a heater and a cooler point on the heater for two different pulse shapes.

By switching to a higher heating rate after a pre-heat phase the race is won by bubble nucleation because the time lag between different regions of the heater reaching the superheat limit is reduced. FIG. 3 illustrates the concept: even if the spatial temperature uniformity is poor (an unavoidable side effect of low heating rates in the pre-heat phase), the time lag 32 between the hotter and colder regions of the heater reaching the superheat limit can be reduced by switching to a higher heating rate 36 after the pre-heat. In this way, the colder regions reach the superheat limit before they are thermally isolated by bubbles expanding from hotter regions. The majority of the heater surface reaches the superheat limit 34 before significant bubble expansion occurs, so the heater area will be more effectively and consistently utilised for bubble formation.

FIGS. 4A to 4D demonstrate the effectiveness of shaped pulses in producing large, stable bubbles. The bubble size can be increased tremendously using shaped pulses, without suffering the irregularity shown in FIGS. 1A to 1E. A circuit designer will have a choice of voltage modulation or pulse width modulation of the heating signal to create the shaped pulse, but generally pulse width modulation is considered more suitable to integration with e.g. a CMOS driver circuit. As an example, such a circuit may be used to generate maintenance pulses in an inkjet printhead, where the increased bubble impulse is better able to recover clogged nozzles as part of a printer maintenance cycle. This is discussed in the co-pending application Ser. No. 11/544,770, the contents of which are incorporated herein by reference.

Figure 5:
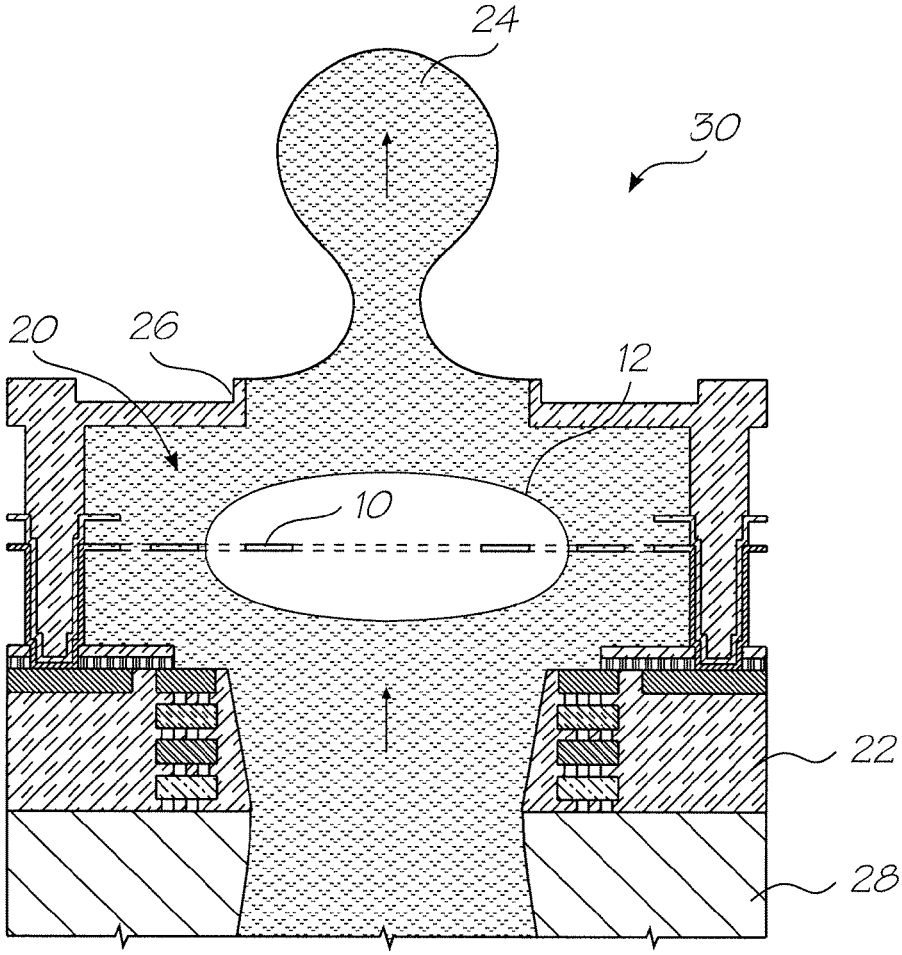

FIG. 5 shows the MEMS bubble generator of the present invention applied to an inkjet printhead. A detailed description of the fabrication and operation of some of the Applicant's thermal printhead IC's is provided in U.S. Ser. No. 11/097,308 and U.S. Ser. No. 11/246,687. In the interests of brevity, the contents of these documents are incorporated herein by reference.

A single nozzle device 30 is shown in FIG. 5. It will be appreciated that an array of such nozzles are formed on a supporting wafer substrate 28 using lithographic etching and deposition techniques common within in the field semi-conductor/MEMS fabrication. The chamber 20 holds a quantity of ink. The heater 10 is suspended in the chamber 20 such that it is in electrical contact with the CMOS drive circuitry 22. Drive pulses generated by the drive circuitry 22 heat the heater 10 to generate a vapour bubble 12 that forces a droplet of ink 24 through the nozzle 26. Using the drive circuitry 22 to shape the pulse in accordance with the present invention gives the designer a broader range of bubble impulses from a single heater and drive voltage.

Figure 4A:
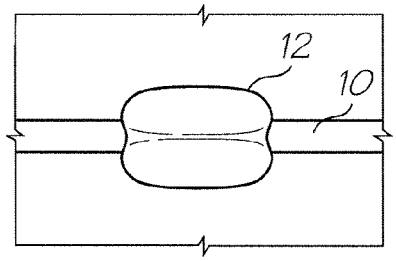
FIG. 4A shows water vapour bubbles generated using a traditional square-shaped pulse.
Figure 4B:
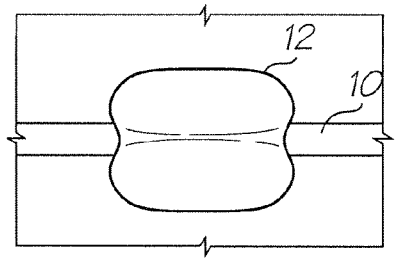
FIG. 4B shows a bubble generated using a pulse shaped by pulse width modulation.
Figure 4C:
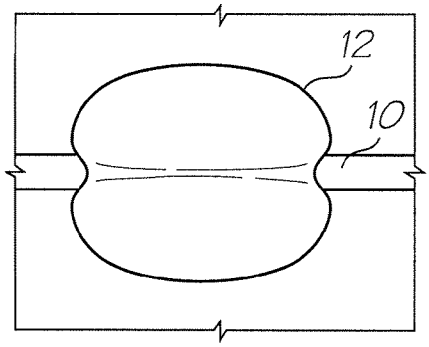
FIGS. 4C and 4D show a bubble generated using voltage modulated pulses; and, FIG. 5 shows the MEMS bubble generator in use within an inkjet printhead.
Figure 4D:
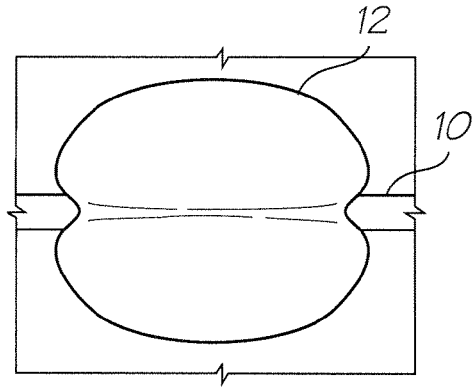

FIGS. 4A to 4D show stroboscopic images of water vapor bubbles in an open pool on a 30 μm×4 μm heater. Like FIGS. 1A to 1E, the bubbles 12 have been captured at their maximum extent. FIG. 4A shows the prior art situation of a simple square profile pulse of 4.2V for 0.7 microseconds. In FIG. 4B, the pulse is shaped by pulse width modulation—a pre-heat series having nine 100 nano-second pulses separated by 150 nano-seconds, followed by a trigger pulse of 300 nano-seconds, all at 4.2V. The bubble size in FIG. 4B is greater because of the amount of thermal energy transferred to the liquid prior to nucleation in the trigger pulse. In FIGS. 4C and 4D, the pulses are voltage modulated. The pulse of FIG. 4C has a pre-heat portion of 2.4V for 8 microseconds, followed by 4V for 0.1 microseconds to trigger nucleation. In contrast, the FIG. 4D pulse has a pre-heat section of 2.25V for 16 microseconds followed by a trigger of 4.2V for 0.15 microseconds. These figures clearly illustrate that bubbles generated using shaped pulses (FIGS. 4B, 4C and 4D) are larger, regular in shape and repeatable.

With the problem of irregularity or non-repeatability removed, the designer has great flexibility in controlling the bubble size at the design phase or during operation by altering the length of the pre-heat section of the pulse. Care must be given to avoiding accidentally exceeding the superheat limit during the pre-heat section so that nucleation does not occur until the trigger section. If the pulse is pulse width modulated, the modulation should be fast enough to give a reasonable approximation of the temperature rise generated by a constant, reduced voltage. Care must also be given to ensuring the trigger section takes the whole heater above the superheat limit with enough margin to account for system variances, without overdriving to the extent that the heater is damaged. These considerations can be met with routine thermal modelling or experiment with the heater in an open pool of liquid.

The invention has been described herein by way of example only. Ordinary workers in this field will readily recognise many variations and modifications that do not depart from the spirit and scope of the broad inventive concept.

The invention claimed is:

1. An inkjet printhead having a plurality of micro-electro-mechanical vapor bubble generators each comprising:

a nozzle in fluid communication with an ink chamber;

a heater positioned in thermal contact with ink in the chamber; and drive circuitry configured to provide a voltage and time modulated pulse to the heater to generate a vapor bubble in the ink in said chamber, the pulse comprising a pre-heat pulse of a first voltage and duration immediately followed by a trigger pulse of a second voltage and duration, the second voltage of the trigger pulse being higher than the first voltage of the pre-heat pulse.

2. The printhead of claim 1, wherein the drive circuitry is configured to provide the pre-heat pulse with the first voltage and duration of 2.4V for 8 microseconds, immediately followed by the trigger pulse with the second voltage or duration of 4V for 0.1 microseconds to trigger nucleation in the ink.

3. The printhead of claim 1, wherein the drive circuitry is configured to use amplitude modulation to decrease power of the pre-heat pulse relative to the trigger pulse.

* * * * *